US011877680B2

(12) United States Patent
Yessin et al.

(10) Patent No.: US 11,877,680 B2
(45) **Date of Patent: *Jan. 23, 2024**

(54) AUDIO SYSTEM FOR A COLLECTION BOX

(71) Applicant: UNITED STATES POSTAL SERVICE, Washington, DC (US)

(72) Inventors: Gabriel Michael Yessin, Arlington, VA (US); William Albert Tartal, Baltimore, MD (US); Joram Shenhar, Fairfax, VA (US); Joel Dewnandan, Bladensburg, MD (US)

(73) Assignee: UNITED STATES POSTAL SERVICE, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/161,564

(22) Filed: Jan. 30, 2023

(65) Prior Publication Data

US 2023/0172379 A1 Jun. 8, 2023

Related U.S. Application Data

(63) Continuation of application No. 16/710,613, filed on Dec. 11, 2019, now Pat. No. 11,564,522.

(Continued)

(51) Int. Cl.
*A47G 29/122* (2006.01)
*A47G 29/12* (2006.01)

(Continued)

(52) U.S. Cl.
CPC ..... *A47G 29/1225* (2013.01); *A47G 29/1207* (2013.01); *A47G 29/1218* (2013.01);

(Continued)

(58) Field of Classification Search
CPC ..... A47G 29/1225; A47G 29/1251; A47G 29/1207; A47G 29/1218; A47G 29/22;

(Continued)

(56) References Cited

U.S. PATENT DOCUMENTS 5,255,843 A 10/1993 Deakyne
5,382,945 A 1/1995 Novak (Continued)

OTHER PUBLICATIONS

Office Action issued in U.S. Appl. No. 16/710,613 dated Sep. 29, 2021, (11 pages total).

(Continued)

*Primary Examiner* — William L Miller
(74) *Attorney, Agent, or Firm* — MH2 TECHNOLOGY LAW GROUP, LLP

(57) ABSTRACT

Systems are disclosed for producing audio that is audible outside a collection box for delivery items, the collection box including a user-operated door. The system can include a trigger device, a sensor, an audio transducer that generates the produced audio from an audio signal, an audio chip and one or more processors. The sensor can detect the trigger device when the trigger device is in close proximity, and the one or more processors can be operably connected to the sensor and to the audio chip, where the one or more processors signal the audio chip to send the audio signal to the audio transducer. The one or more processors can further receive and record a status signal indicating that the door is in an opened state. Systems can further include an environmental sensor that measures environmental information.

20 Claims, 9 Drawing Sheets

Related U.S. Application Data

(60) Provisional application No. 62/934,377, filed on Nov. 12, 2019, provisional application No. 62/778,756, filed on Dec. 12, 2018.

(51) Int. Cl.
*A47G 29/22* (2006.01)
*A47G 29/124* (2006.01)

(52) U.S. Cl.
CPC ..... *A47G 29/1251* (2017.08); *A47G 29/22* (2013.01); *A47G 2029/1226* (2013.01); *A47G 2200/066* (2013.01); *A47G 2200/08* (2013.01); *A47G 2200/143* (2013.01); *A47G 2200/166* (2013.01)

(58) Field of Classification Search
CPC ..... A47G 2029/1226; A47G 2200/066; A47G 2200/08; A47G 2200/143; A47G 2200/166
See application file for complete search history.

(56) References Cited

U.S. PATENT DOCUMENTS 5,440,294 A 8/1995 Mercier et al.
5,499,014 A 3/1996 Greenwaldt
5,664,728 A 9/1997 Jones
5,917,411 A 6/1999 Baggarly
6,046,675 A 4/2000 Hanna
6,275,154 B1 8/2001 Bennett et al.
6,462,659 B1 10/2002 Schuette
6,694,580 B1 2/2004 Hatzold
6,788,203 B1 9/2004 Roxbury et al.
7,061,377 B1 6/2006 Kraus
7,222,779 B1 5/2007 Pineda-Sanchez et al.
7,486,948 B1 2/2009 Vergon
7,506,796 B1 3/2009 Hanna
7,786,862 B1 8/2010 Campbell
2005/0104730 A1 5/2005 Yang
2005/0247771 A1 11/2005 Engel
2008/0067227 A1 3/2008 Poss et al.
2008/0290151 A1 11/2008 Usmani
2016/0247344 A1 8/2016 Eichenblatt
2017/0286905 A1 10/2017 Richardson et al.
2017/0295979 A1 10/2017 Appell
2018/0070753 A1* 3/2018 Eveloff ..... H04W 4/025
2020/0071991 A1 3/2020 Patel
2020/0187693 A1 6/2020 Yessin et al.
2020/0351474 A1 11/2020 Gaudiano Del Bosque et al.
2020/0397172 A1 12/2020 Kennett
2021/0103725 A1 4/2021 Tartal et al.
2021/0251409 A1 8/2021 Kennett

OTHER PUBLICATIONS

Office Action issued in U.S. Appl. No. 16/710,613 dated May 11, 2022, (9 pages total).

* cited by examiner

AUDIO SYSTEM FOR A COLLECTION BOX

CROSS-REFERENCE TO RELATED APPLICATIONS

This application is a continuation of U.S. patent application Ser. No. 16/710,613 filed on 11 Dec. 2019, which claims the benefit of and priority to U.S. Provisional Application No. 62/778,756, filed on 12 Dec. 2018 and U.S. Provisional Application No. 62/934,377, filed on 12 Nov. 2019, which are hereby incorporated by reference in their entireties.

BACKGROUND

Various agencies and companies provide delivery services, such as the U.S. Postal Service (USPS), the Federal Express Corporation (FedEx™), and the United Parcel Service Corporation (UPS™). Often, the items that are delivered by these services are placed in a collection box (e.g., a corner mail box) by the sender, and the delivery service (e.g., the USPS) retrieves the delivery items from the collection box according to a schedule (e.g., once daily) and places the delivery items into the delivery stream for sorting, routing, transporting, etc.

When a sender places an item(s) in a collection box, that person is standing in front of or is near the collection box for period of time that is from about two to four seconds, and that could be longer. During the time when the person is near the collection box, that person is not receiving any information or entertainment from the collection box, other than information that may be written on the collection box, if the person choses to read it.

It is thus desirable to provide new systems and devices that can provide information and/or entertainment to collection-box users, such as audio information, audio entertainment, and optionally illumination. It is also desirable to make such new systems and devices such that they can be easily added or retrofitted to existing collection boxes and provide them with a new audio capability.

BRIEF SUMMARY

Described herein are systems, devices, and techniques for producing audio that is audible outside a collection box for delivery items, where the collection box includes a user-operated door for putting delivery items into the collection box. In various embodiments, the system can include a trigger device, a sensor, an audio transducer that generates the produced audio from an audio signal, an audio chip and one or more processors. In various embodiments, the trigger device is in close proximity with the sensor when the door is in the closed state, the trigger device moves out of the close proximity with the sensor when the door is in the opened state, and the sensor can produce a signal indicating the proximity of the trigger device to the sensor. Moreover, in various embodiments, the one or more processors can be operably connected to the sensor and to the audio chip, where the one or more processors signal the audio chip to send the audio signal to the audio transducer upon receiving the signal from the sensor, and where the one or more processors receives and records a status signal indicating that the door is in an opened state.

In some variants or embodiments, close proximity between the sensor and the trigger device includes contact between the sensor and the trigger device. In other variants, the trigger device can be integral to the door of the collection box or the trigger device can be attached to the door of the collection box.

In some variants, the one or more processors can include a microcontroller, and in other variants the one or more processors can further include a second microcontroller. Further still, in some embodiments, the microcontroller can signal the audio chip to send the audio signal to the audio transducer, and in other variants the system can further include an audio amplifier operably connected to the audio transducer that amplifies the audio signal.

In some variants or embodiments, the system can further include a memory device that is operably connected to the one or more processors and that includes data for an audio clip.

Also described herein are further variants of systems, devices, and techniques for producing audio that is audible outside of the collection box, where the collection box includes a door configured to exhibit a closed state and an opened state when manipulated by a user. In various embodiments, the system can include a trigger device, a sensor, an audio transducer that generates the produced audio from an audio signal, one or more processors operably connected to the sensor and to the audio transducer, an amplifier that is operably connected to the audio transducer and that amplifies the audio signal, and an environmental sensor that measures environmental information that is operably connected to the one or more processors. In various embodiments, the trigger device is in close proximity with the sensor when the door is in the closed state, the trigger device moves out of the close proximity with the sensor when the door is in the opened state, and the sensor can produce a signal indicating the proximity of the trigger device to the sensor. Moreover, in various embodiments, the one or more processors can be operably connected to the sensor and to the audio transducer, where the one or more processors send the audio signal to the audio transducer upon receiving the signal from the sensor, and where the one or more processors receives and records a status signal indicating that the door is in an opened state. Further still, in embodiments, the one or more processors receives and records the environmental information from the environmental sensor.

In some variants or embodiments, the environmental information can be temperature information, and the environmental sensor can be a temperature sensor that measures temperature in the collection box and produces the temperature information. In other variants or embodiments, the environmental information can be humidity information, and the environmental sensor can be a humidity sensor that measures humidity in the collection box and produces the humidity information. Further still, in other variants or embodiments, the environmental information can be temperature information and humidity information, and the environmental sensor can include a temperature sensor that measures temperature and produces the temperature information, and a humidity sensor that measures humidity and produces the humidity information.

Again, in some variants or embodiments, close proximity between the sensor and the trigger device includes contact between the sensor and the trigger device.

Further still, in some variants, the one or more processors can include a microcontroller, and in other variants the one or more processors can further include a second microcontroller. Further still, in some embodiments, the microcontroller can generate the audio signal in response to the signal from the sensor.

In some variants or embodiments, the system can further include a memory device that is operably connected to the one or more processors and that includes data for an audio clip. In other variants or embodiments, the one or more processors can include an audio chip, and in yet other variants or embodiments, the audio chip can send the audio signal to the audio transducer.

DESCRIPTION OF DRAWINGS

The accompanying drawings, which are incorporated in and constitute a part of this specification, illustrate embodiments of the present teachings and together with the description, serve to explain the principles of the present teachings. In the drawings.

DETAILED DESCRIPTION

Reference will now be made in detail to the present examples of embodiments of the disclosure, several examples of which are illustrated in the accompanying drawings.

In various implementations, the audio system, subsystem, or device, and/or an environmental system, device, or subsystem, can be used in or with any type of collection box having a movable door that is opened or otherwise operated by a user to place a delivery item inside of the collection device, including typical collection boxes provided by any type of delivery service, such as the U.S. Postal Service, another nation's postal service, the FedEx™ company, the UPS™ company, or the like.

Figure 1:
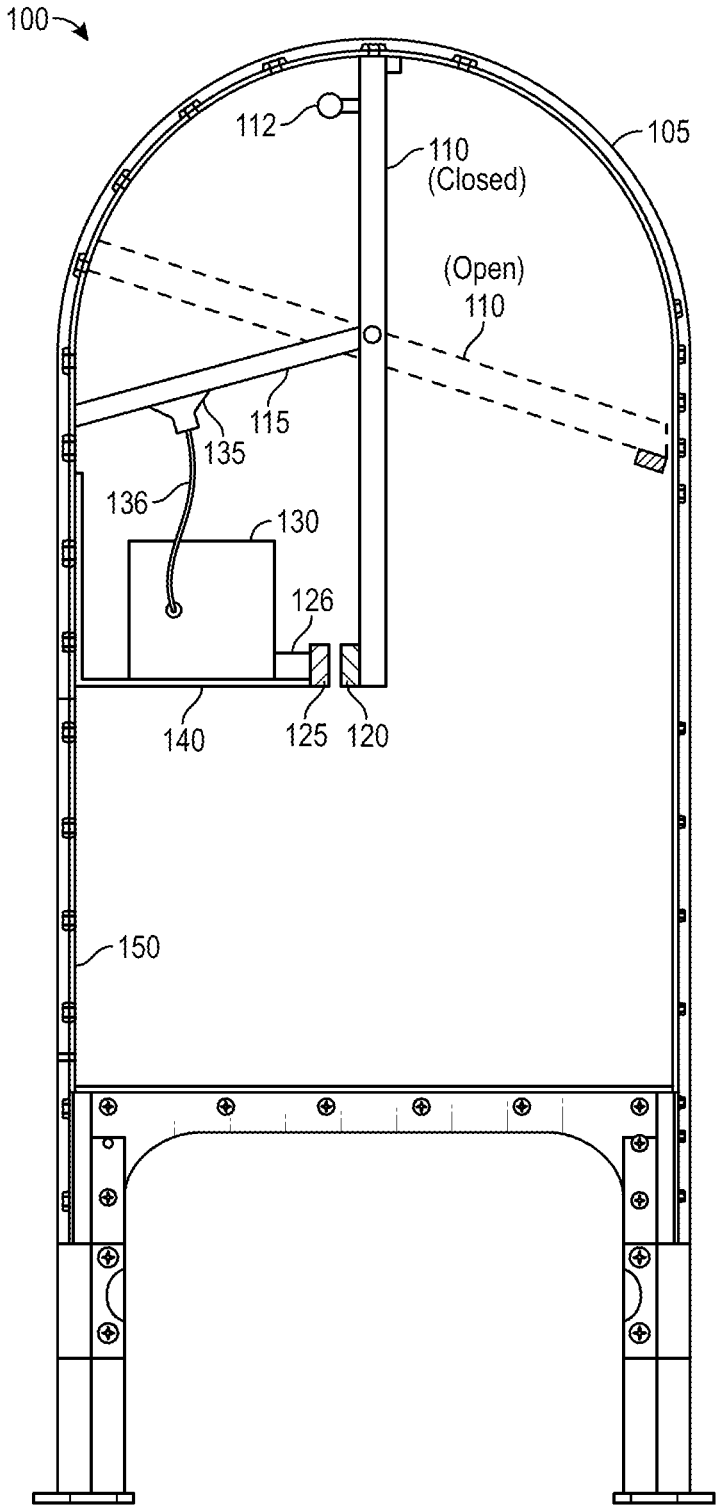
FIG. 1 is a side view cut-away diagram illustrating an example of an audio system installed in a collection box, consistent with certain disclosed embodiments.

FIG. 1 is a side view cut-away diagram illustrating an example of an audio system (and/or an environmental system in some embodiments) that is installed in a collection box 100, consistent with certain disclosed embodiments. One of ordinary skill will recognize that the example shown in FIG. 1 is simplified for clarity and conciseness of explanation. As shown in the cut-away example of FIG. 1, the collection box 100 for delivery items (for example, the model 1170K collection box deployed by the USPS) includes an outer shell 105, a slanted shelf 115, a door 110, a handle 112 on the door 110, and a collection door 150.

The form and operations of these particular components are conventional, and are well known to those skilled in the art. To briefly summarize, when at rest and closed, the door 110 is configured to hang or repose in a substantially vertical orientation, as illustrated by the solid-line position labelled "110 (closed)" in FIG. 1. When in use and opened by a user (e.g., a person that is mailing or sending a letter or other delivery item), the door 110 is configured to pivot or rotate or otherwise move to an almost horizontal orientation, as illustrated by the dashed-line position labelled "110 (open)" in FIG. 1. In operation, a person that wants to deposit a delivery item (e.g., the letter), into the collection box 100 pulls the handle 112 of the door 110 to pivot or move the door 110 toward the dashed-line 110 (open) position, places the delivery item into the opening on top of the open door 110, and releases the door 110 so that it can swing back to the substantially vertical 110 (closed) orientation, which causes the delivery item to slide or fall into the bottom of the collection box 100. An employee of the delivery service (e.g., a mail carrier) may periodically unlock and open the collection door 150 to gather the deposited delivery items from the bottom of the collection box 100 and bring them to a processing facility for sorting, routing, transporting, etc.

As shown in the example of FIG. 1, various implementations of the novel audio system described herein include a trigger device or structure 120, such as a magnet, that is attached to or integral with the end of the door 110 that is opposite to the end of the door that includes the handle 112. The trigger-device end may also be referred to as the lower or bottom end of the door 110. Thus, the trigger device 120 moves with the bottom end of the door 110 when the door 110 is opened and closed by a person. In various implementations, the trigger device 120, (e.g., the magnet 120) may be attached to the bottom end of the door 110 of a conventional collection box 100 using a fastener(s) such as a sheet metal screw(s) or a bolt(s) and nut(s), or using an adhesive, such as an epoxy cement.

Figure 7A:
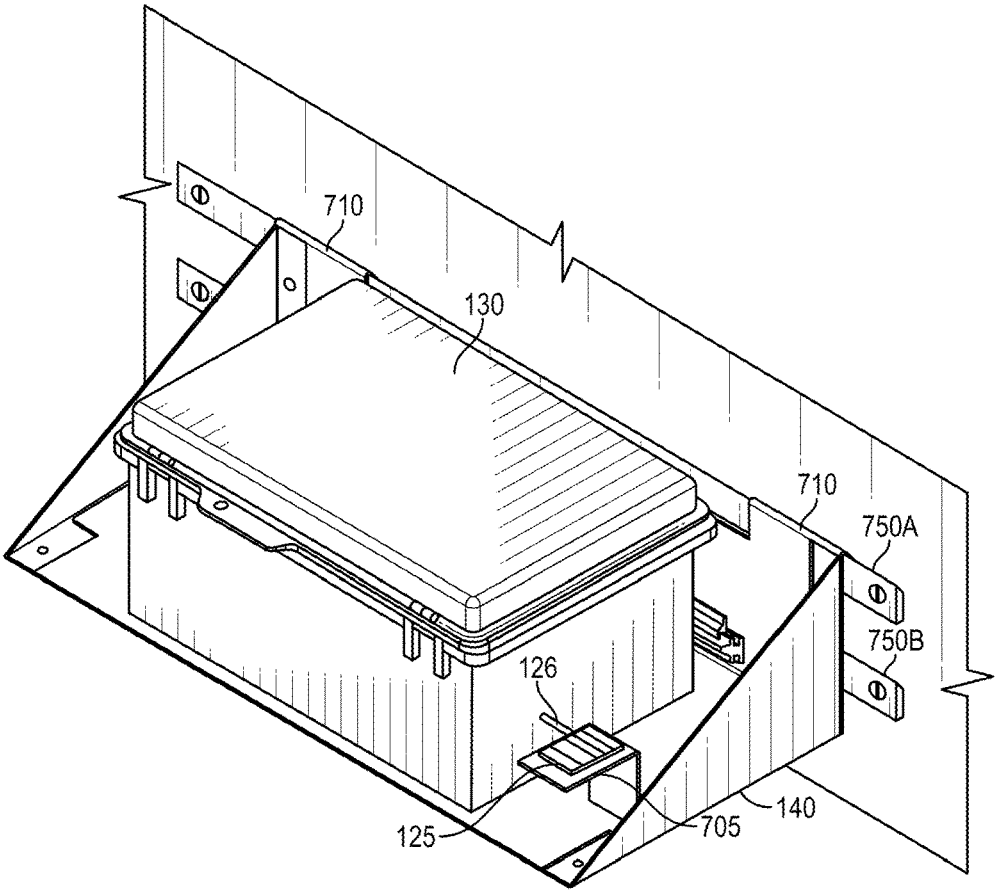
FIG. 7A is a rear left perspective view of an example of a shelf and an enclosure for a processing system, where the shelf is hanging from a security bar, consistent with an embodiment of the invention.
Figure 7B:
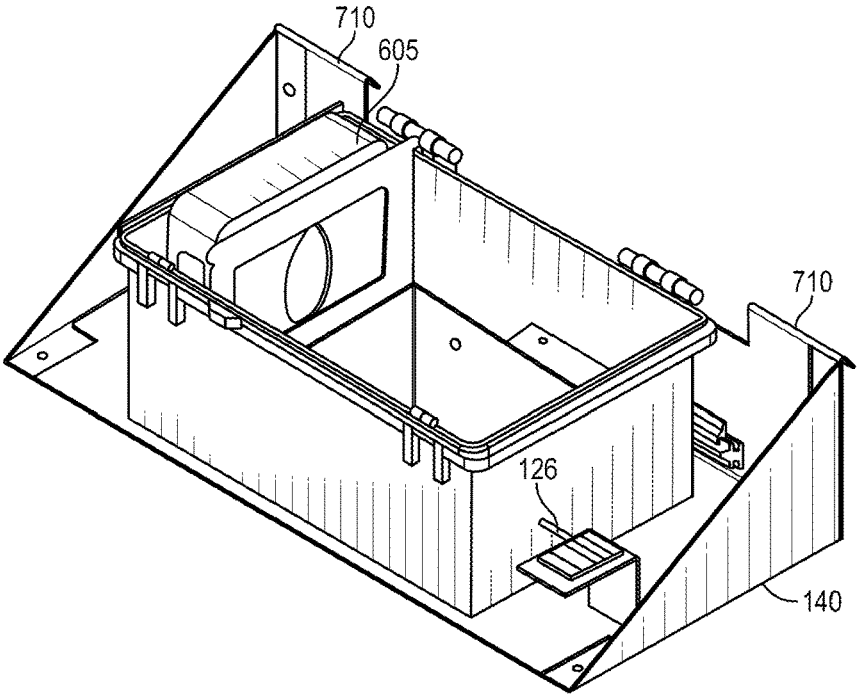
FIG. 7B is a rear left perspective view of an example of the shelf and the enclosure of FIG. 7A with the top removed, consistent with an embodiment of the invention.
Figure 8:
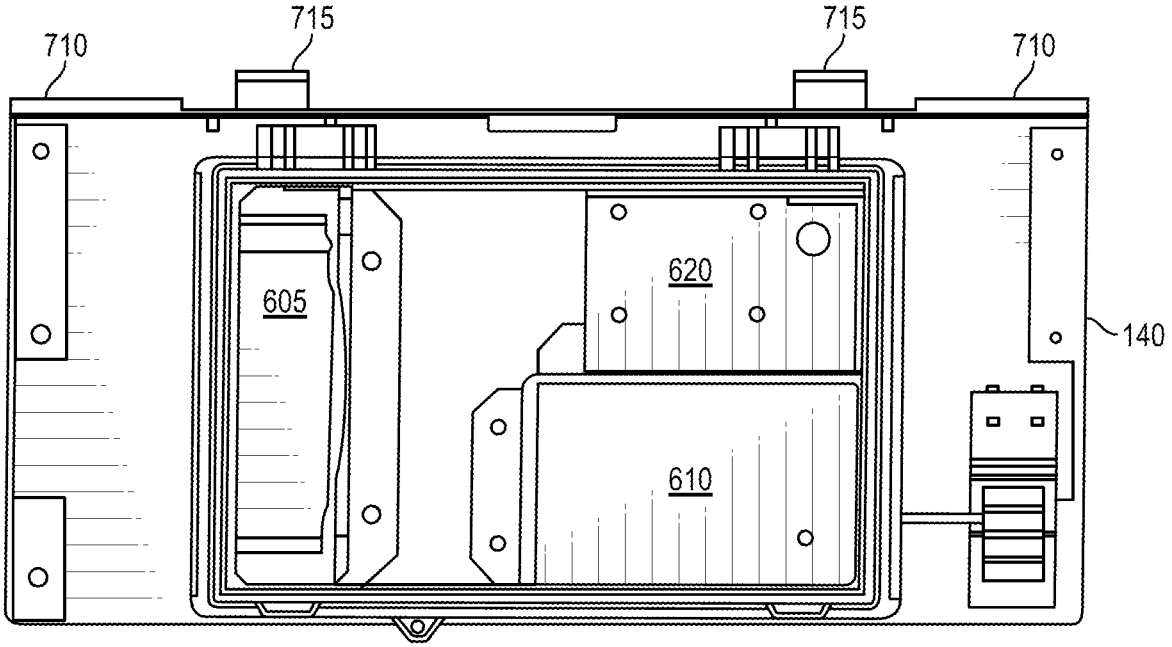
FIG. 8 is a top down view of an example of the shelf and the enclosure of FIG. 7A, with the top removed, consistent with an embodiment of the invention.

Various implementations of the audio system described herein may also include a platform or shelf 140 that is attached directly or indirectly to the inner surface of the outer shell 105 of the collection box 100 in a configuration or position that allows interaction with the bottom end of the door 110 as described herein. In various implementations, the shelf 140 may be fashioned from metal, such steel sheet metal, or plastic, or the like. In some implementations, the shelf 140 may be attached to the collection box 100 using a fastener(s) such as sheet metal screw(s), or bolt(s) and nut(s), or rivet(s), or the like, or using an adhesive, such as an epoxy cement. In some other implementations (not shown in FIG. 1), the shelf 140 may be attached to the collection box 100 using hooks that hook onto a bar structure on the front wall inside of the collection box 100 above the collection door 150. In some such implementations, the bar structure may be one or more conventional security bars inside the collection box 100. An example of such a hookand-bar attachment and implementation is shown in FIGS. 7A-B and 8 and is described below.

As shown in the example of FIG. 1, a sensor 125 is attached to the shelf 140 in a configuration or position that enables the sensor 125 to sense, activate, signal, or detect when the trigger device 120 is near, in close proximity to, and/or contacting the sensor 125. In various implementations the shelf 140 may be configured (e.g., positioned and attached) on the outer shell 105 and/or the sensor 125 may be configured, attached, or coupled on the shelf 140 in a manner that positions and aligns the sensor 125 in close proximity to, or in contact with, the trigger device 120 when the door 110 is in the closed position. In various implementations, in the closed position, the distance between the sensor 125 and the trigger device 120 is close enough that the sensor 125 can sense or detect the trigger device 120, such as a distance of from about 0 to about 20 mm; for example, in contact, 1 mm apart, 2 mm apart, 3 mm apart, 4 mm apart, or 5 mm apart. In some implementations, the trigger device 120 may be a magnet and the sensor 125 may be a magnetic switch, such as a magnetic reed switch. In some other implementations, the trigger device 120 may be a metal or wood block and the sensor 125 may be a miniature snap-action switch or micro switch, where the metal or wood block 120 must contact an actuator of the micro switch 125 in order for the micro switch to detect it. Other types of sensors, switches, and triggering devices may also be used.

In some implementations, the trigger device 120 is integral with, or may be, the door 110 or a portion of the door 110. In some such implementations, the sensor 120 may be a contact switch or the like, which detects, activates, or signals when the door 110 comes into physical contact with it.

As illustrated in the example of FIG. 1, the sensor 125 is electrically connected to a processing system 130 by a wire(s) 126 or the like.

Figure 2:
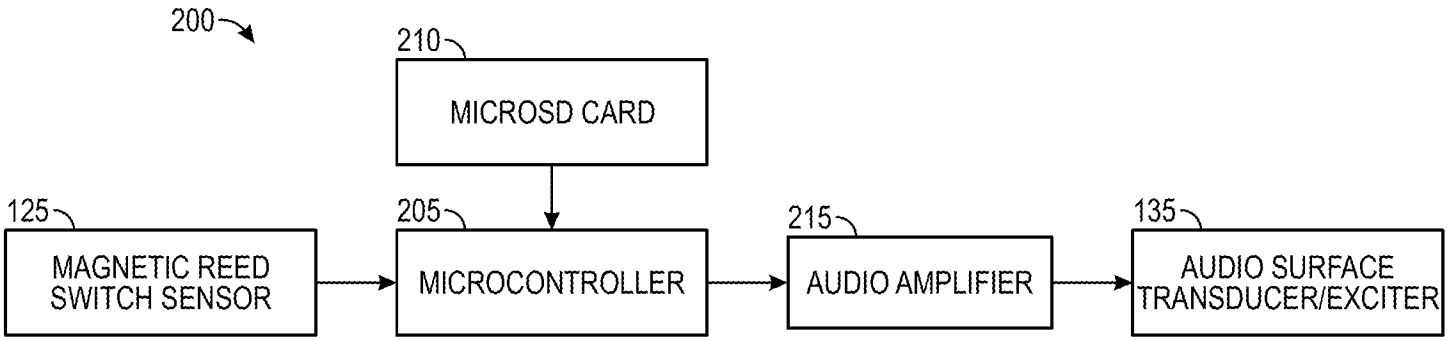
FIG. 2 is a block diagram illustrating an example of an audio system for a collection box, consistent with an embodiment of the invention.
Figure 3:
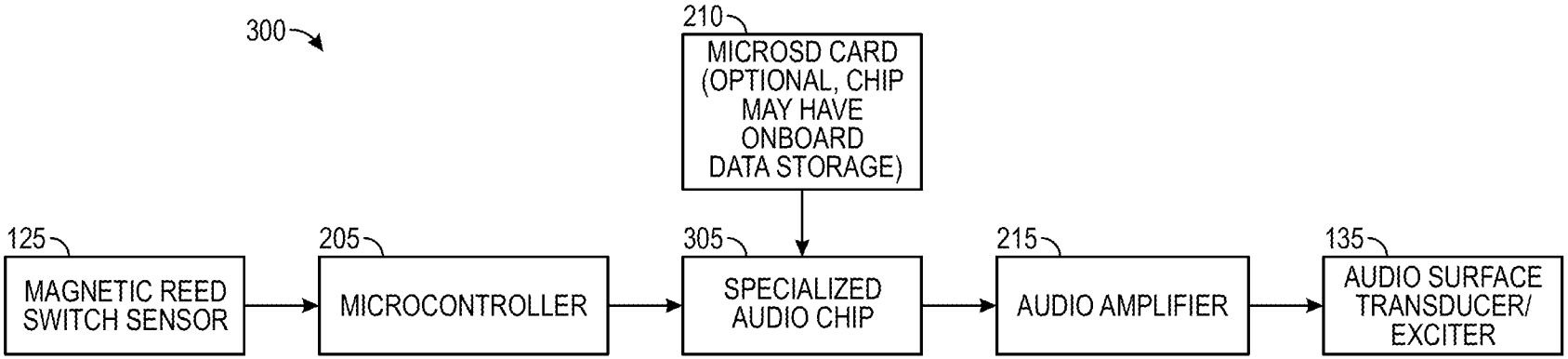
FIG. 3 is a block diagram illustrating another example of an audio system for a collection box, consistent with an embodiment of the invention.
Figure 4:
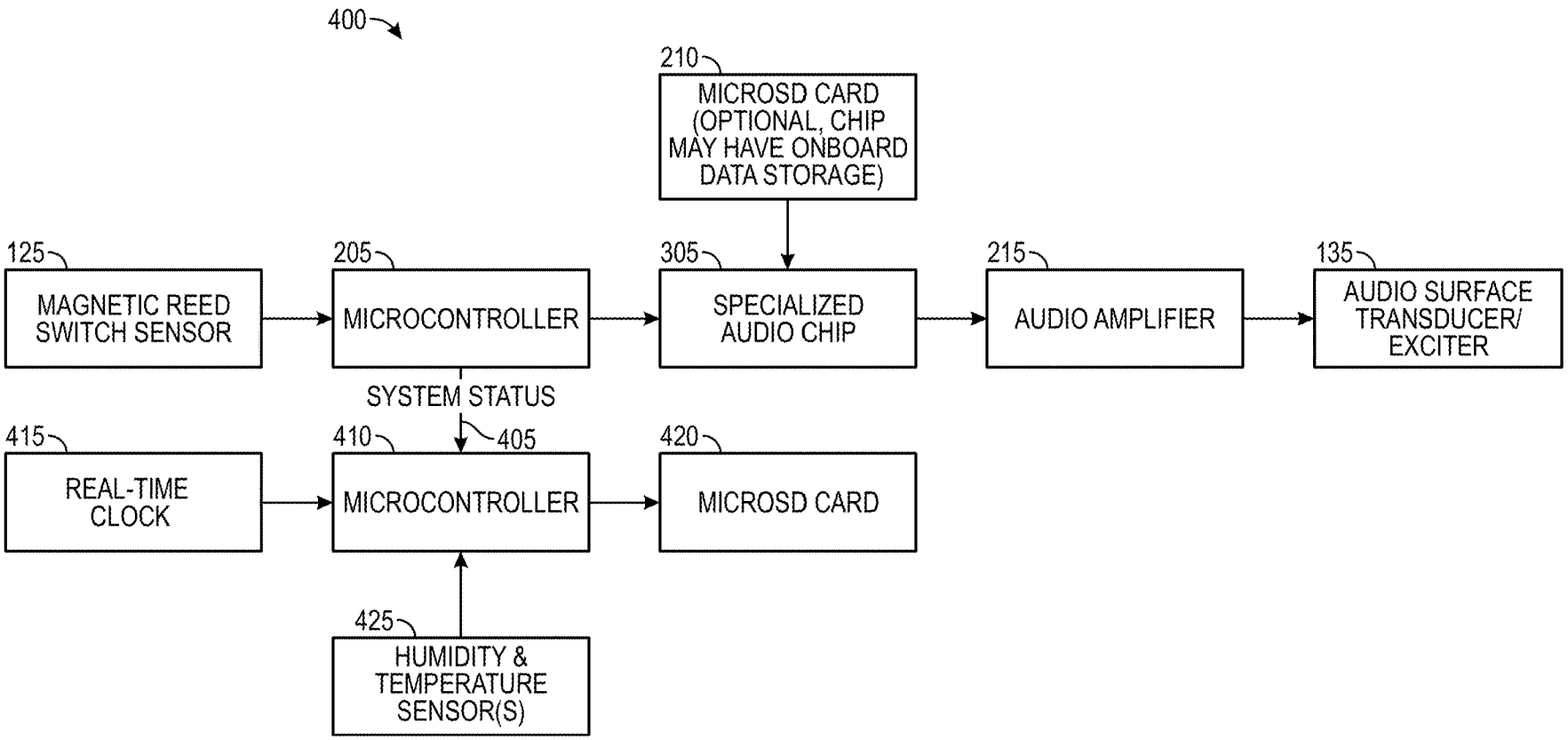
FIG. 4 is a block diagram illustrating an example of an audio and environmental system for a collection box, consistent with an embodiment of the invention.

In various implementations, the processing system 130 includes components (e.g., a microprocessor and/or an audio chip) that generate an audio signal in reaction to a signal from the sensor 125 indicating that the trigger device 120 has moved away from, (e.g., more than about 5 mm from, more than about 8 mm from, or more than about 10 mm from), or out of contact with, the sensor 125. This occurs, for example, when a person pulls open the door 110 in order to deposit a letter or the like into the collection box 100. In some embodiments, the processing system 130 may also, or alternatively, react to a signal from the sensor 125 indicating that the trigger device 120 has moved close to, (e.g., within about 5 mm of), or into contact with, the sensor 125. This occurs, for example, when a person releases or closes the door 110 after depositing a letter or the like into the collection box 100. Examples of implementations of the processing system 130 are shown in FIGS. 2-4, which are described below The audio signal generated by the processing system 130 is sent to a transducer(s) 135, such as an audio speaker(s), that is connected to the processing system 130 by a wire(s) 136 or the like. The audio transducer 135 converts the electrical audio signal into sounds that can be heard by a person (not shown) standing in front of or otherwise positioned near the collection box 100, for example, the person who has opened the door 110, which triggered the sensor 125. In the example shown in FIG. 1, the transducer 135 is an audio surface transducer or surface exciter that is attached to the inside face of the slanted shelf 115 that forms part of the conventional collection box 100. This configuration uses the slanted shelf 115 as a resonant surface to generate the sound. In some implementations, the audio transducer 135 may be attached to the slanted shelf 115 using an adhesive, such as an epoxy cement, or using a fastener(s) such as a sheet metal screw or a bolt and nut, or the like. In other implementations where the transducer 135 is a conventional loudspeaker, the slanted shelf 115 may have openings in it to allow the sound from the loudspeaker 135 to better pass through the slanted shelf 115 and reach the user of the collection box 100.

The collection box 100 with an audio system shown in FIG. 1 is merely one example of a configuration that can be used with the disclosed embodiments, and is not intended to be limiting. In various embodiments, additional components or fewer components and/or additional or fewer functions and/or different component placements can be implemented without departing from the principles of the invention. For example, the system 100 can include multiple transducers 135 of one or more types or the shelf 140 or the sensor 125 may be mounted in a different location or in multiple locations. For instance, the sensor 125 may be positioned so as to detect the trigger device 120 when the door 110 enters or is positioned in the open position, instead of when the door leaves the closed position, and the processing system 130 may be configured to generate an audio signal in response to the sensor 125 detecting that the trigger device 120 has come into close proximity or contact with the sensor 125, when the door 110 is in the open position.

FIG. 2 is a block diagram illustrating an example of an audio system 200 for a collection box 100, consistent with an embodiment of the invention. In this example, the sensor 125 is a magnetic switch, e.g., a magnetic reed switch; the trigger device 120 (not shown in FIG. 2) is a magnet; and the transducer 135 is an audio surface transducer (also known as a surface exciter).

In the example shown, the components included in the processing system 130 are a processor 205 or a microcontroller 205 that is operably connected to a microSD card 210 (or a similar memory device) and to an audio amplifier 215. The microcontroller 205 is also operably connected to the magnetic reed switch sensor 125, and the audio amplifier 215 is also operably connected to the audio surface transducer 135. In various embodiments, the microcontroller 205, the memory device 210 (e.g., a microSD card 210) and the audio amplifier 215 may be mounted and interconnected on a circuit board, or the like, which may include or be connected to a power supply (not shown) for these components and the other powered components. In various embodiments, the power supply may be a rechargeable battery, or the like.

In the implementation shown, the microSD card 210 or other memory device stores audio or sound clips, such as songs, advertisements, spoken delivery-service-related information, other types of spoken information, and the like. In some embodiments, the sound clips may range from about 5 seconds long to about 30 seconds long, such as about 10 seconds long or about 20 seconds long. In some other embodiments, at least some of the sound clips may be longer. As a few examples, the sound clips may provide audio information about products (e.g., stamps, etc.), services (e.g., registered mail, collection box pickup times, etc.), rates (e.g., postage), or the like offered by the delivery service that maintains the collection box. In other examples, the sound clips may provide music, such as seasonal music or music tied to, or associated with, a delivery-service product, service, or promotion—for example a song by a singer that is pictured on a new postage stamp. In still other examples, the sound clips may provide audio advertisements for third-party services or businesses, such as a nearby coffee shop, or the like. In still other examples, the sound clips may provide an audio security-related warning, announcement, or sound, such as an alarm sound to draw attention to a collection box that is being illicitly moved or stolen. Another example is an alarm sound that is triggered when the collection box 100 has been tipped over or otherwise manipulated such that the door 110 remains open for a predetermined amount of time that is unusually long compared to normal operation open times, for example, 10 seconds or more; e.g., 20 seconds, 25 seconds, 30 seconds, 40 seconds, or one minute.

Referring now to FIGS. 1 and 2, in operation for the embodiment shown, when the door 110 is closed, the magnet 120 that is on the lower or bottom end of the door 110 is in very close proximity to the reed switch sensor 125, which keeps the reed switch 125 in a first state (e.g., open or low in some implementations; closed or high in other implementations; etc.). When the door 110 is opened by a person to deposit a letter or package or the like, then the magnet 120 will move or swing away from the reed switch sensor 125 along with the lower end of the door 110, which will cause the reed switch 125 to change to a second state (e.g., closed or high). This state change signal from the reed switch sensor 125 (e.g., going from either high to low or low to high) is detected by the microcontroller 205. In various implementations, the microcontroller 205 (a.k.a. the processor) is programmed to be in a sleep state until it receives a state change signal (e.g., a specific signal that indicates that the door 110 has been opened, such as low to high signal) from the reed switch sensor 125, which wakes up the microcontroller 205. Upon receiving the appropriate signal from the reed switch sensor 125, the microcontroller 205 wakes up, and executes instructions to measure or determine whether or not the signal from the reed switch sensor 125 stays in the proper door-open state (e.g., stays high) for a predetermined amount of time before triggering an audio response. In various implementations, this predetermined amount of time for startup of the audio signal (e.g., the startup threshold time) may be from about 5 to about 900 milliseconds; such as, for example, 100 milliseconds or 200 milliseconds. Waiting the predetermined amount of time reduces false positives for the openings of the door 110, (e.g., playing audio when a user has not opened the door 110), as the collection box 100 may be bumped or impacted, or the door may bounce when it is released and allowed to close quickly, such that the door 110 momentarily swings or moves away from the reed switch sensor 125 and then returns, even though a person did not actually open the door 110.

If the signal from the reed switch sensor 125 stays in the door-open state (e.g., stays high) for the predetermined amount of time, then the microcontroller 205 will play an audio clip, which may be in the form of data stored in a memory 210, such as a microSD card 210. In various embodiments, the microSD card 210 may store one sound clip or several different sound clips. In various embodiments, the microcontroller 205 may always play an entire sound clip; i.e. generate an audio signal from the data of the entire sound clip. In some embodiments, the microcontroller 205 may play the sound clip either until its end, or until a predetermined amount of time has elapsed (e.g., a shut-off limit time, such as 5, 10, or 15 seconds), or until the door 110 is closed as indicated by a transition signal (e.g., high to low) from the reed switch sensor 125, or some combination of these conditions. In some embodiments, the microcontroller 205 may play each sound clip of multiple clips stored on the card 210 in order before repeating a clip, while in other embodiments, the sound clips may be played in random order.

In the embodiment shown, the microcontroller 205 generates and sends or transmits an audio signal that is generated from or based on the sound clip to the audio amplifier 215, which amplifies the audio signal in a conventional manner. The audio amplifier 215 may be needed in some embodiments because the microcontroller 205 may produce an audio signal of only a few tens of milliwatts that is too weak to drive the audio transducer 135 and may in some circumstances damage the microcontroller 205. In various implementations, the audio amplifier 215 may amplify or boost the microcontroller 205's low-power audio signal to a power range that can loudly drive the transducer(s) 135, such as about three watts. In some implementations, the audio amplifier 215 may also perform additional audio signal processing functions, such as filtering the signal, smoothing the signal, and the like. In some implementations the microcontroller 205 may perform such functions before sending the audio signal to the audio amplifier 215. In various implementations, the audio may be preprocessed and filtered to optimize audio quality using another system and then stored in the memory 210. In some implementations, the microcontroller may also analyze the audio and use the analysis to perform other tasks, such as visual feedback, as discussed below. In some implementations this analysis is done by a separate chip, as discussed below. In still other implementations, the analysis may be done ahead of time, possibly on a separate system, and the results stored in the microcontroller 205, the memory 210, or the like.

In some embodiments, the audio amplifier 215 may be omitted if the microcontroller 205 produces an audio signal that is powerful enough to drive the transducer 135 in a manner that produces sound that is loud enough to be easily heard by a person using the collection box 100.

As shown in this example, the audio amplifier 215 provides the amplified audio signal to the audio surface transducer 135. The audio surface transducer or exciter 135 has technical advantages over a conventional loudspeaker in the context of a collection box 100. Mounting a loudspeaker inside is undesirable, as the collection box 100 defines a large open interior space with typically metal walls, which produces strong attenuation, undesirable echoes, and other sound quality degradation. Mounting a loudspeaker exterior to the box 100 is also relatively undesirable, as it requires drilling, cutting, or otherwise significantly altering the box 100, it exposes the loudspeaker to the weather elements and vandalism, and it may compromise the box's security. To reduce or eliminate these drawbacks, an audio surface transducer or exciter 135 may be mounted to an inside surface of the box 100, and it turns the surface that it is attached to into a speaker. In the example shown in FIG. 1, the slanted shelf 115 acts as a speaker when the audio surface transducer 135 is attached to its inside surface. The audio surface transducer 135 causes the slanted shelf 115 to vibrate to produce sound that is easily heard by a user outside the collection box 100. In various embodiments, more than one audio surface transducers 135 may be operably connected to the audio amplifier 215 and attached to the surface(s) of the collection box 100. For example, two audio surface transducers 135 may be used to create stereo sound, and they may be placed to maximize the quality of the sound produced for a user of the collection box 100.

FIG. 3 is a block diagram illustrating another example of an audio system 300 for a collection box 100, consistent with an embodiment of the invention. The components 125, 205, 210, 215, and 135 are the same as described above with respect to FIGS. 1 and 2. This implementation adds a specialized audio chip 305 to the processing system 130, which chip 305 is operably connected to the microcontroller 205, the audio amplifier 215, and the microSD card (or other memory device) 210. As noted in FIG. 3, the microSD card 210 may be omitted in some implementations where the specialized audio chip 305 includes memory and performs the function of storing the digital audio clips or data.

In the example shown in FIG. 3, the microcontroller 205, in response to detecting the door-open condition via the reed switch sensor 125, instigates or signals the specialized audio chip 305 to produce or generate or play an audio signal using or from the digital data of a sound clip, where the particular clip may also be specified by the microcontroller 205. Although, as in FIG. 2, the microcontroller 205 may be able to produce the audio signal, it may not be specifically designed for that function, and thus the specialized audio chip 305 produces better quality audio signals, which provide a better experience for the person using the collection box 100. In addition, the specialized audio chip 305 offloads the sound processing from the microcontroller 205, which could reduce the operating power and temperature of the microcontroller 205 and could thus increase its longevity. In addition, the specialized audio chip 305 may have improved or easier to implement audio analysis capabilities. In some implementations the specialized audio chip 305 may be embodied as multiple chips with the same or different capabilities and features.

FIG. 4 is a block diagram illustrating an example of an audio and environmental system 400 for a collection box 100, consistent with an embodiment of the invention. The components 125, 205, 305, 210, 215, and 135 are the same as described above with respect to FIGS. 1-3. This implementation of the processing system 130 adds a second microcontroller 410, which is operably connected to the microcontroller 205, a real-time clock 415, a second memory 420, such as a microSD card 420, and humidity and/or temperature sensors 425. In various implementations, other environmental sensor(s) that measure the environment inside or around the collection box 100 may additionally or alternatively be used, such as noise sensors, motion sensors, etc. In some implementations, the real-time clock 415 may be part of or incorporated into the second microcontroller 410, as opposed to being a separate component or device. In various implementations, the temperature sensor may be a thermal sensor or the like that measure temperature and produces digital or electronic temperature information for the second microcontroller 410, and/or the humidity sensor may be a hygrometer, humidistat, or the like that measure humidity and produces digital or electronic humidity information for the second microcontroller 410. In some implementations, the humidity and/or temperature sensors 425 may be mounted inside the collection box 100 and/or inside an enclosure surrounding the processing system 130, (e.g., an enclosure as shown in FIG. 7). In some implementations, the humidity and/or temperature sensors 425 may be mounted outside of the collection box 100 (e.g., on the bottom surface of the collection box 100). And in some other implementations, the sensors 425 may be mounted both inside and outside the box 100.

In this example, the second microcontroller 410 collects, and stores in the second microSD card 420, data about the operation (e.g., openings) of the door 110 and about the environment (e.g., temperature and humidity) in and/or around the collection box 100. As shown in FIG. 4, the microcontroller 205 sends system status data 405 to the second microcontroller 410 when it detects a door-open condition via the magnetic reed switch sensor 125 and triggers the playing of an audio clip. In some embodiments, the system status data 405 may be a binary signal, e.g., a transition to high on one of the pins of the microcontroller 205, that is detected by the second microcontroller 410 and classified as a door open/audio playing event. In some embodiments, the second microcontroller 410 may also read reed switch sensors 125 directly and there may be no communication between the microcontrollers.

In various implementations, the second microcontroller 410 is programmed to be in a sleep state until it receives a system status signal 405 (e.g., a signal that indicates that the door 110 has been opened, such as low to high signal, or a signal indicating that the door 110 has been closed, or the like, e.g., from the microcontroller 205). Upon receiving this signal, the second microcontroller 410 wakes up, and executes instructions to read the time from the real-time clock 415, and record or store the time (e.g., a timestamp) along with information indicating a door open/audio playing event, in the second microSD card 420. In various implementations, the microcontroller 410 is programmed to also wake up periodically (and/or in response to a signal from the microcontroller 205, and/or in response to a signal from the real-time clock 415) and record the temperature and/or humidity along with a timestamp. In some implementations, the period for recording the temperature and/or humidity may from about 15 minutes to about eight hours; for example, every 30 minutes. The recorded door-opening, temperature and/or humidity data may be used for various purposes, including collection box usage statistics and placement decisions, component selection for the audio system and/or processing system 130, etc.

In some embodiments, the processing system 130 may include only environment-measuring components 410, 415, 420, and 425 (and thus no audio-related components), and may or may not include the sensor 125 and the trigger device 120. In such embodiments the processing system 130 may measure and store environmental information and data and/or may measure and store information about the opening and/or closing of the door 110, which reflects the times and amount of use of the collection box 100. In some other embodiments, the processing system 130 may have only a single microcontroller that performs the functionality of both the microcontroller 205 and the microcontroller 410 as described herein. In such embodiments, there may also be a single microSD card that stores the data of both microSD cards 210 and 420 as described herein.

The components and functions described in FIGS. 1-4 are merely examples that are consistent with disclosed embodiments, and are not intended to be limiting. Various other embodiments are possible within the scope of this disclosure. For example, in some variants the processing system 130 may include means for communicating usage (e.g., a count of door openings) and/or environmental data (e.g., periodic temperature and humidity measurements) to a device outside of the collection box. For instance, the processing system 130 may include a wireless transceiver (e.g. a Bluetooth™ transceiver or cellular transceiver) and/or a USB port that is accessible from inside or outside the collection box 100 and that can transmit data to, and/or receive data or commands from, a cell phone, tablet, laptop, server, or the like. For another example, some embodiments of the processing system 130 (e.g., as shown in the examples of FIGS. 2-4) may further include an audio volume controlling device or circuit, which may include a control knob or the like mounted on the enclosure of the processing system 130 (or elsewhere) that a user can operate to adjust the volume of the sound heard outside of the collection box. For yet another example, some embodiments of the processing system 130 (e.g., as shown in the examples of FIGS. 2-4) may further include a reset device or circuit, which may include a control (e.g., a push button) mounted on the enclosure of the processing system 130 (or elsewhere) that a user can operate to reset the processing system 130, e.g., by temporarily cutting the power when pressed, which may be done in the case of a fault or the like.

Figure 5:
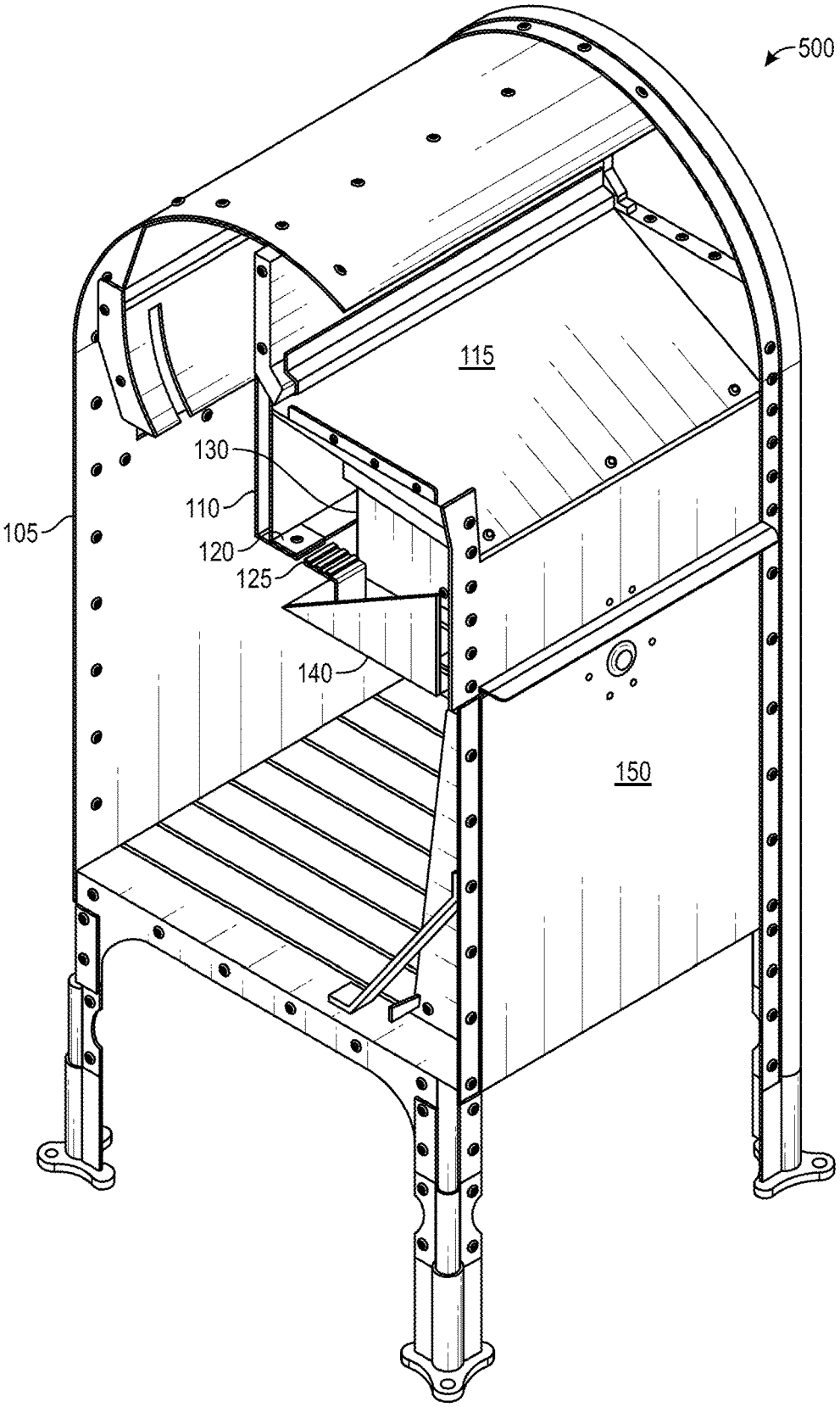
FIG. 5 is a front left perspective view of an example of a collection box that includes an audio system, with the left side panel removed, consistent with an embodiment of the invention.

FIG. 5 is a front left perspective view of an example of a collection box 500 that includes an audio system, with a side panel removed, consistent with an embodiment of the invention. In this example, the shelf 140 includes triangular side panels, as shown. As in FIG. 1, the shelf 140 holds or mounts the processing system 130 and mounts or positions the sensor 125 such that the sensor 125 aligns in close proximity to (and/or in contact with) the trigger device 120 that is attached to the door 110, when the door 110 is in the closed position as shown.

Figure 6A:
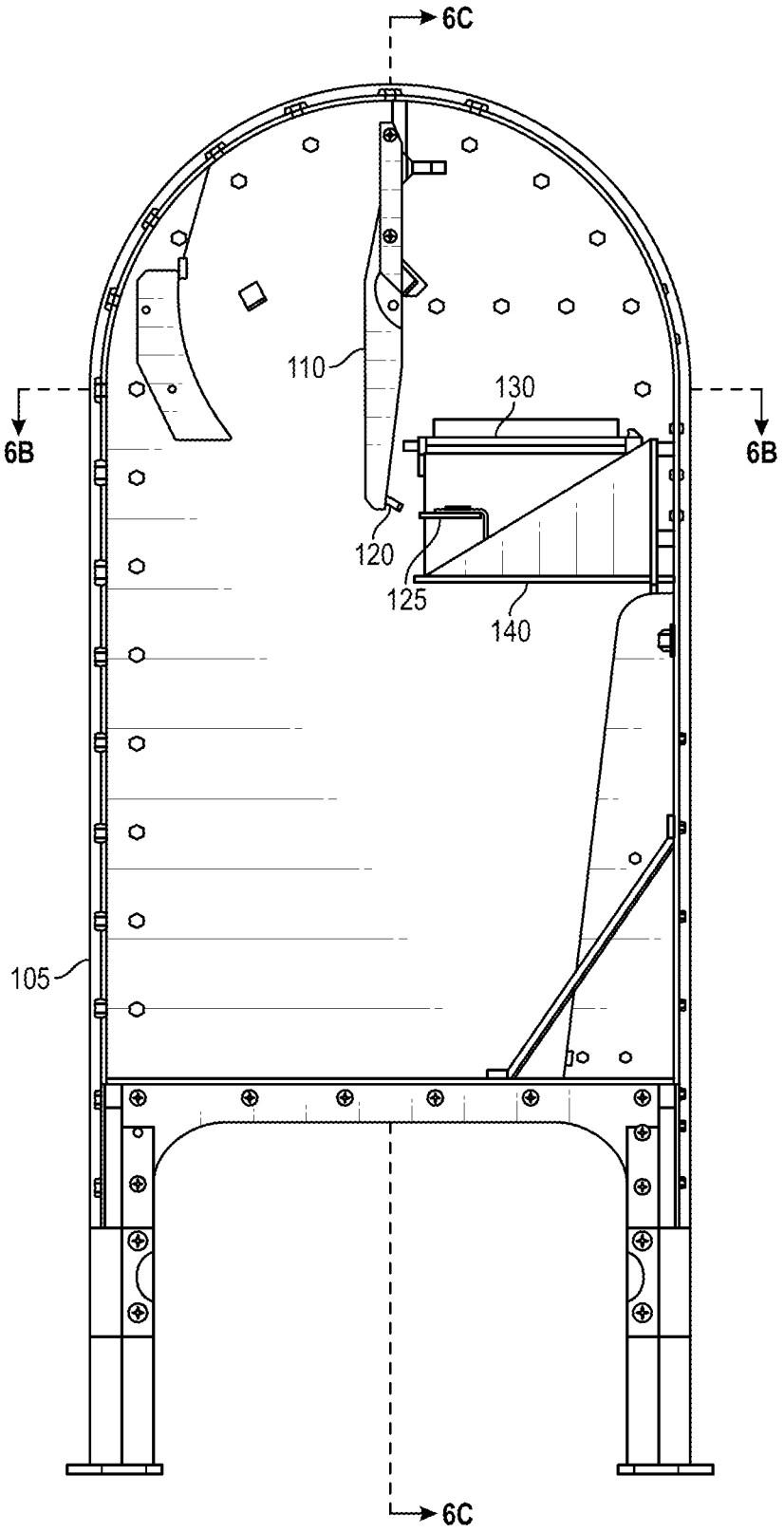
FIG. 6A is a left side view of an example of a collection box that includes an audio system, with the left side panel removed, consistent with an embodiment of the invention.

FIG. 6A is a left side view of the collection box 500 that includes an audio system, with the left side panel removed, consistent with an embodiment of the invention. In this figure, and in FIGS. 6B and 6C, the tilted shelf 115 and transducer 135 have been omitted in order to more clearly show the other structures. In the example shown in FIG. 6A, the components of the processing system 130 are housed in an enclosure or container, such as a tray or a box with a hinged lid or a removable cover. In various implementations, the enclosure may be fashioned from a plastic material, such as polystyrene or the like, or from metal, such steel sheet metal, or the like. In embodiments that include a container for the components of the processing system 130, the wires 126, 136 (not shown in FIG. 6A) may be routed through openings in, or attached to connectors mounted on, one or more sides of the enclosure.

FIG. 6A also shows a cross section cut line 6B and a cross section cut line 6C for the views described next.

Figure 6B:
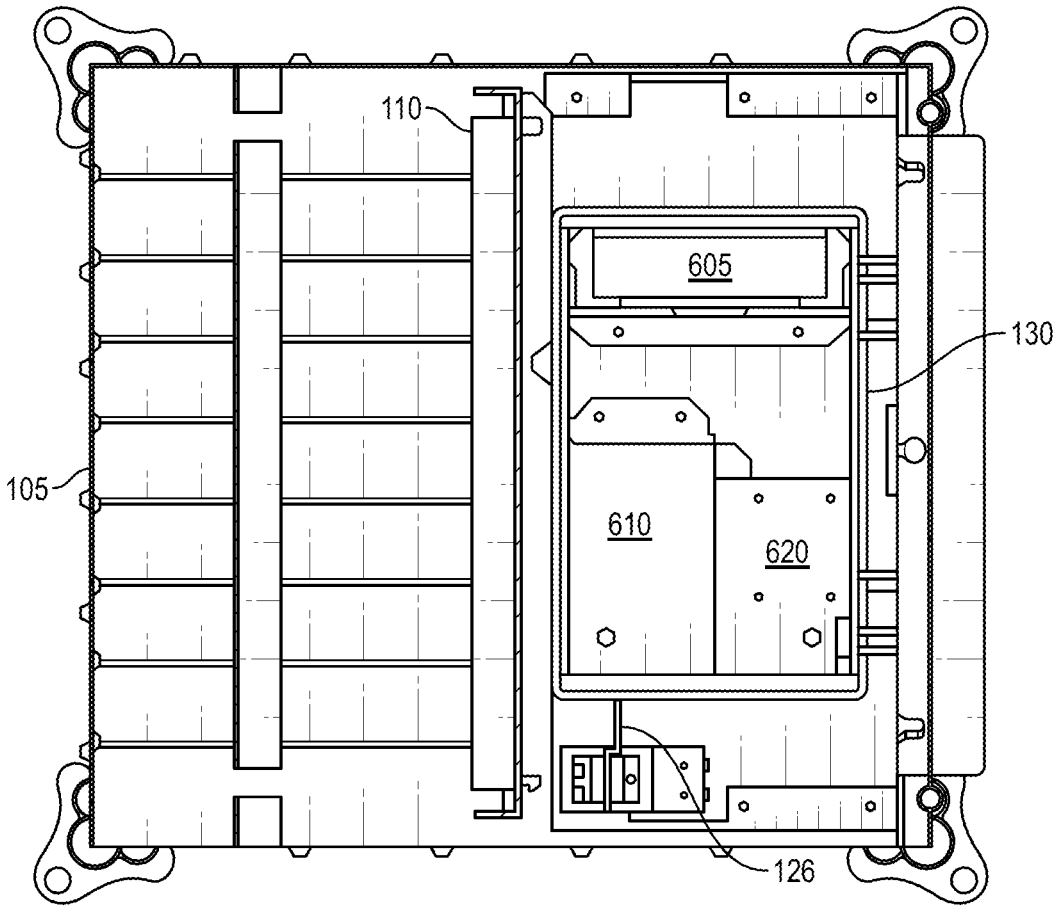
FIG. 6B is a top-down cross sectional view through section 6B of the collection box of FIG. 6A, consistent with an embodiment of the invention.

FIG. 6B is a top-down cross sectional top-down view through section 6B of the collection box 500 of FIG. 6A, consistent with an embodiment of the invention. This figure shows an example of the placement of some components related to the processing system 130, such as a dehumidifier 605 (e.g., a desiccant dehumidifier) that lowers the humidity within the processing system 130's enclosure to prevent humidity-related problems for the electronic components, a power supply 610 (e.g., a replaceable, rechargeable battery) to power the electronic components, and a circuit board 620, which is operably connected to the power supply 610. In various implementations, the circuit board 620 includes one or more microcontroller 205, 410 one or more microSD card 210, 420 (or a similar memory device), zero or more audio amplifier 215, zero or more specialized audio chip 305, and/or zero or more environment sensor 425, (such as a humidity sensor(s) and/or a temperature sensor(s)), for example as described above with respect to FIGS. 2-4. In embodiments where the components of the processing system 130 are in their own closed enclosure or container, such as a lidded box or tray, one or more of the humidity and/or temperature sensors 425 may be mounted inside the closed container (e.g., to monitor the environment of the processing system 130), and/or may be separate from the circuit board 620 and mounted outside the closed container (e.g., to monitor the environment inside or outside of the collection box 500), and/or may be mounted both inside and outside the closed container.

Figure 6C:
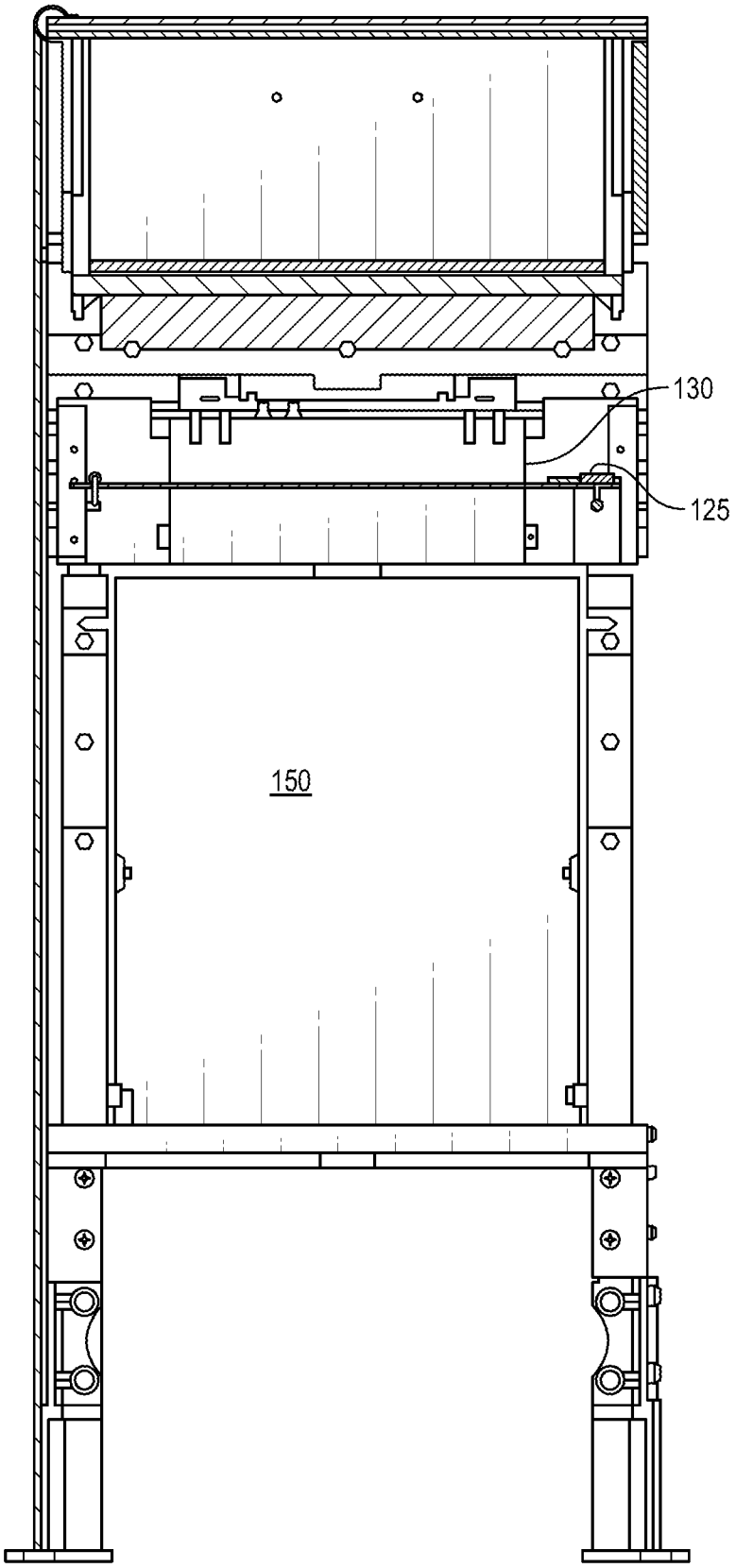
FIG. 6C is a rear side cross sectional view through section 6C of the collection box of FIG. 6A, consistent with an embodiment of the invention.

FIG. 6C is a rear side cross sectional view through section 6C of the collection box 500 of FIG. 6A, consistent with an embodiment of the invention. This view shows that the tray 140 and the processing system 130 are mounted above the collection door 150 so as not to interfere with its operation or the general operation of the collection box 500 (e.g. regular collection of the deposited mail).

FIG. 7A is a rear left perspective view of an example of a shelf 140 and an enclosure for a processing system 130, consistent with an embodiment of the invention. In this example, the enclosure is implemented as a lidded plastic box, with the lid closed. As shown, the sensor 125 is mounted on a tab or bracket 705, which is mounted to shelf 140, which bracket 705 configures or places the sensor 125 at a position and orientation such that the sensor 125 is in position to operate correctly with the triggering device 120 (not shown in this FIG.), e.g., such that the sensor 125 is near, in close proximity to, and/or contacting the trigger device 120 when the door 110 is closed. In various implementations, the bracket 705 is horizontally and/or vertically adjustable so that the position and orientation of the sensor 125 can be customized for variations in doors 110, etc. As shown in this example, the wire 126 is connected to the sensor 125 and passes through the side of the enclosure for the processing system 130 to connect with a component of the processing system 130, such as the microcontroller 205. The wire 126 can pass through the side of the enclosure for the processing system 130 by various means. Consistent with an embodiment of the invention, this may be or include a gland (not shown) affixed to the side of the side of the enclosure for the processing system 130, which allows entry of the wire 126 while keeping the enclosure for the processing system 130 sealed.

FIG. 7B is a rear left perspective view of an example of the shelf and the enclosure of FIG. 7A, with the top removed, consistent with an embodiment of the invention. As shown, in various implementations, the enclosure for the processing system 130 may include or contain the dehumidifier 605, which can regulate or affect the humidity level inside the enclosure for the processing system 130 and/or the humidity level inside the collection box 100, 500.

In some implementations, as shown in FIGS. 7A and B, the shelf 140 includes a pair of hooks 710, which are used to mount the shelf 140 inside the collection box 500. In particular, the hooks 710 may engage with a first (upper) conventional security bar 750A (shown in FIG. 7A) that is inside the front upper face of the collection box 500, below the slanted shelf 115, such that the shelf hangs off of the first security bar 750A. As shown in this example, the hooks 710 may be formed by rolling over the top edges of the material (e.g. sheet metal) that forms the shelf 140. As shown in the example of FIG. 7A, the collection box 500 may also include a second (lower) conventional security bar 750B that is inside the front upper face of the collection box 500 and below the first security bar 750A. The interaction of the shelf 140 and the second security bar 750B is explained with respect to FIG. 8.

FIG. 8 is a top down view of an example of the shelf and the enclosure of FIG. 7A, with the top removed, consistent with an embodiment of the invention. In various implementations, as shown, the shelf 140 includes a pair of horizontal protrusions or tabs 715, which are used to mount the shelf 140 inside the collection box 500. In particular, the tabs 715 may interact or engage with the second, lower, conventional security bar 750B (not shown in FIG. 8; see FIG. 7A) that is inside the front upper face of the collection box 500 and below the first, upper, security bar 750A. The tabs' 715 engagement with the second security bar 750B is such that the tabs 715 prevent the shelf 140 from moving vertically or upward in a manner that disengages the hooks 710 from the upper, first security bar 750A; e.g., the tabs 715 of the shelf 140 protrude under the second, lower security bar 750B when the shelf 140 is hung on the upper security bar 750A via the hooks 710.

For implementations as shown in FIGS. 7A-B and 8 that attach the shelf 140 to the collection box 500 using the hooks 710 and the tabs 715, in order to remove the shelf 140, the shelf 140 must be tilted or rotated around the axis of the hooks 710 far enough so that the tabs 715 disengage from (e.g. move out from under) the lower security bar 750B, and then the shelf 140 can be lifted vertically to disengage (e.g., unhook) the hooks 710 from the upper security bar.

In some such implementations, a locking bar or strap (not shown) may be used to prevent the shelf 140 from being rotated unintentionally, which prevents the tabs 715 and the hooks 710 from disengaging with the security bars 750A, B.

The audio system for the collection box 500 shown in FIGS. 1-8 is merely one possible example that is consistent with the inventions, and is not intended to be limiting. Many variations are possible within the scope of this disclosure. For example, in some other embodiments, the audio system may be an audio and visual system (or just a visual system), which controls, in a manner similar to the audio components described, lights that are placed on, in, or under the collection box 500, such as small LED lights. Such embodiment may have lights in addition to, or as an alternative to, the audio transducers 135. When the collection box door is opened, such lights could be used for entertainment or information purposes, similar to the purposes for audio sounds, or could also be used for illumination or security purposes. For another example, as noted previously, the audio system for the collection box 500 may also have, or be replaced with, an environmental system that measures and records usage data and/or environmental data in and/or around the collection box 500.

While the innovations have been described with reference to the examples of embodiments, those skilled in the art will be able to make various modifications to the described embodiments without departing from the true spirit and scope of the innovations. The terms and descriptions used herein are set forth by way of illustration only and are not meant as limitations. For example, although various specific components have been described, other components that perform the same or similar functions could be substituted, and although operations, including computing operations, have been described in a specific order, in other implementations the operations may be performed in a different order, or may be performed simultaneously. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

What is claimed is:

1. A system for producing audio for a collection box comprising a door, wherein the door is configured to exhibit at least a closed state and an opened state when manipulated by a user and wherein the produced audio is audible outside of the collection box, the system comprising:

a trigger device;

a sensor that produces a signal indicating the proximity of the trigger device to the sensor, wherein the trigger device is in close proximity with the sensor when the door is in the closed state, and wherein the trigger device moves out of the close proximity with the sensor when the door is in the opened state;

an audio transducer that generates the produced audio from an audio signal;

an audio chip; and one or more processors operably connected to the sensor and to the audio chip, wherein the one or more processors signal the audio chip to send the audio signal to the audio transducer upon receiving the signal from the sensor, and wherein the one or more processors receives and records a status signal indicating that the door is in the opened state.

2. The system of claim 1, wherein the close proximity includes contact between the sensor and the trigger device.

3. The system of claim 1, wherein the trigger device is integral to the door of the collection box.

4. The system of claim 1, wherein the trigger device is attached to the door of the collection box.

5. The system of claim 1, wherein the one or more processors comprise a microcontroller.

6. The system of claim 5, wherein the one or more processors further comprise a second microcontroller.

7. The system of claim 5, wherein the microcontroller signals the audio chip to send the audio signal to the audio transducer.

8. The system of claim 7, further comprising an audio amplifier operably connected to the audio transducer and that amplifies the audio signal.

9. The system of claim 1, further comprising a memory device that that is operably connected to the one or more processors and that includes data for an audio clip.

10. A system for producing audio for a collection box comprising a door, wherein the door is configured to exhibit at least a closed state and an opened state when manipulated by a user and wherein the produced audio is audible outside of the collection box, the system comprising:

a trigger device;

a sensor that produces a signal indicating the proximity of the trigger device to the sensor, wherein the trigger device is in close proximity with the sensor when the door is in the closed state, and wherein the trigger device moves out of the close proximity with the sensor when the door is in the opened state;

an audio transducer that generates the produced audio from an audio signal;

an audio chip;

one or more processors operably connected to the sensor and to the audio chip, wherein the one or more processors send the audio signal to the audio transducer upon receiving the signal from the sensor and wherein the one or more processors receives and records a status signal indicating that the door is in opened state;

an amplifier that is operably connected to the audio transducer and that amplifies the audio signal; and an environmental sensor that measures environmental information and that is operably connected to the one or more processors;

wherein the one or more processors receives and records the environmental information from the environmental sensor.

11. The system of claim 10, wherein the environmental information is temperature information, and the environmental sensor is a temperature sensor that measures temperature in the collection box and produces the temperature information.

12. The system of claim 10, wherein the environmental information is humidity information, and the environmental sensor is a humidity sensor that measures humidity in the collection box and produces the humidity information.

13. The system of claim 10 wherein the environmental information is temperature information and humidity information, and the environmental sensor comprises:

a temperature sensor that measures temperature and produces the temperature information; and a humidity sensor that measures humidity and produces the humidity information.

14. The system of claim 10, wherein the close proximity includes contact between the sensor and the trigger device.

15. The system of claim 10, wherein the one or more processors comprise a microcontroller.

16. The system of claim 15, wherein the one or more processors further comprise a second microcontroller.

17. The system of claim 15, wherein the microcontroller generates the audio signal in response to the signal from the sensor.

18. The system of claim 10, further comprising a memory device that that is operably connected to the one or more processors and that includes data for an audio clip.

19. The system of claim 10, wherein the environmental information is noise information, and the environmental sensor is a noise sensor.

20. The system of claim 10, wherein the environmental information is motion information, and the environmental sensor is a motion sensor.

* * * * *